US005964646A

United States Patent [19]

Kassir et al.

[11] Patent Number: 5,964,646

[45] Date of Patent: Oct. 12, 1999

[54] GRINDING PROCESS AND APPARATUS FOR PLANARIZING SAWED WAFERS

[75] Inventors: Salman M Kassir, Paso Robles; Thomas A Walsh, Templeton, both of Calif.

[73] Assignee: Strasbaugh, San Luis Obispo, Calif.

[21] Appl. No.: 08/971,642

[22] Filed: Nov. 17, 1997

[51] Int. Cl.[6] ..... B24B 1/00

[52] U.S. Cl. ..... 451/41; 451/63; 451/289; 451/388

[58] Field of Search ..... 451/289, 41, 42, 451/43, 63, 494, 388, 285, 287, 288, 390, 921; 269/21

[56] References Cited

U.S. PATENT DOCUMENTS

| | | | |
|---|---|---|---|
| 1,291,572 | 1/1919 | Lorenz | 451/494 |
| 1,353,966 | 9/1920 | Lorenz | 451/494 |
| 4,213,698 | 7/1980 | Firtion et al. | 451/388 |
| 4,521,995 | 6/1985 | Sekiya | 451/388 |
| 4,597,228 | 7/1986 | Koyama et al. | 451/388 |
| 5,029,418 | 7/1991 | Bull | 451/388 |
| 5,232,875 | 8/1993 | Tuttle et al. | 451/63 |
| 5,417,408 | 5/1995 | Ueda | 269/21 |
| 5,421,595 | 6/1995 | Cripe et al. | 269/21 |
| 5,735,731 | 4/1998 | Lee | 451/388 |
| 5,762,539 | 6/1998 | Nakashiba et al. | 451/289 |

*Primary Examiner*—Derris Holt Banks
*Attorney, Agent, or Firm*—Daniel C. McKown

[57] ABSTRACT

A method and apparatus for planarizing silicon wafers initially having wavy surfaces, such as might result from having been cut from a boule by means of a wire saw. A vacuum is applied to one side of a porous ceramic plate, and a perforated resilient pad is applied to the opposite side of the porous ceramic plate. The resilient pad is affixed to the ceramic plate by a peelable adhesive, and the vacuum extends through the perforations of the resilient pad to permit a wafer to be mounted on the exposed side of the resilient pad. The perforations in the resilient pad are distributed uniformally across the wafer, so that the atmospheric pressure pushing the wafer against the resilient pad is also uniform across the wafer. However, the wafer is not deformed while it is held in place for grinding. Because the wafer is not held in an elastically deformed condition while it is ground, the wafer has no tendency to spring back to its original wavy shape. Once one side of the wafer has been planarized, conventional methods can be employed to planarize the second surface of the wafer and to make uniform its thickness. The method is fully compatible with existing grinding machines and, except for the insertion of the resilient pad, requires no departure from the standard grinding techniques.

6 Claims, 2 Drawing Sheets

Fig. 1 (PRIOR ART)
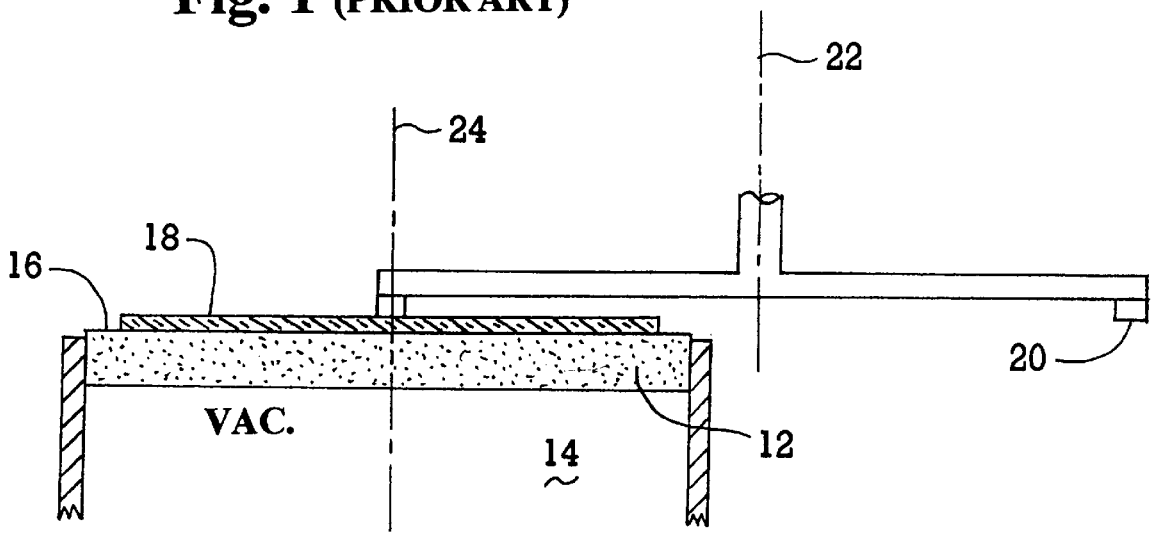
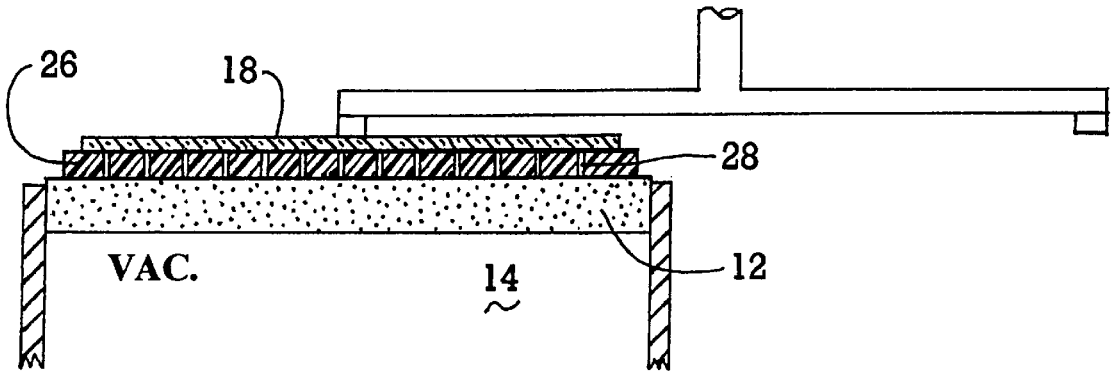
Fig. 2

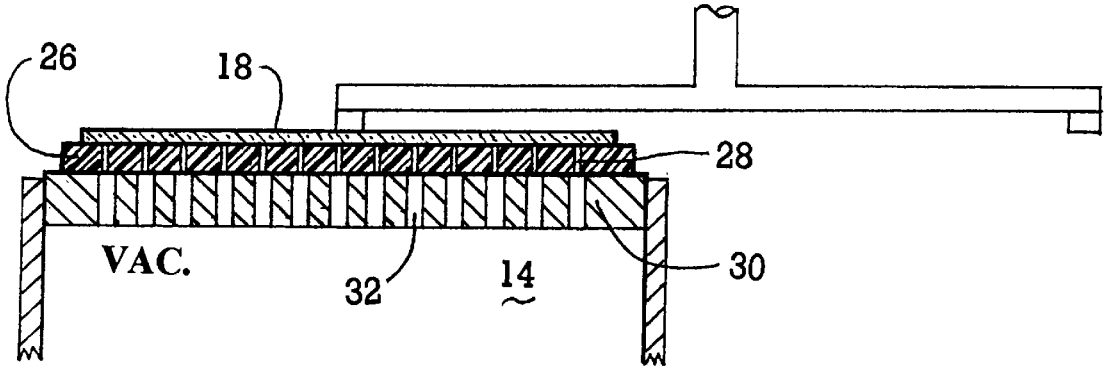
Fig. 3
Fig. 4
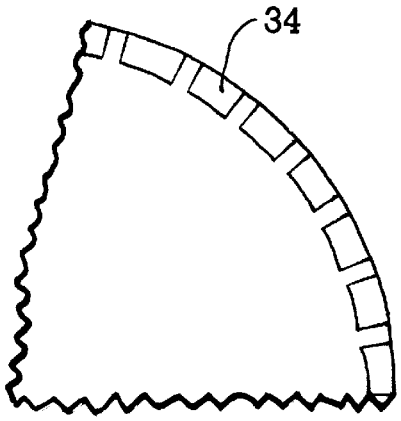

GRINDING PROCESS AND APPARATUS FOR PLANARIZING SAWED WAFERS

BACKGROUND OF THE INVENTION

1. Field of the Invention

The present invention is in the field of semiconductor manufacturing, and it specifically relates to a grinding process for removing the waviness of the surface of a freshly sawed silicon wafer.

2. The Prior Art

In a current practice, boules of single-crystal silicon range from 100 to 300 millimeters in diameter and are cylindrical in shape. These boules are cut with a wire saw or with an internal diameter saw into disc-shaped wafers approximately one millimeter thick. The wire saw reduces the kerf loss and permits many wafers to be cut simultaneously. However, the use of these saws results in undesirable waviness of the surfaces of the wafer. The surfaces need to be made more plane (planarized) before they can be polished, coated, or subjected to other processes. It is not unusual for the amplitude of the waves in each surface of a wafer to exceed 30 micrometers, and application of the process of the present invention typically renders each surface flat to within a fraction of one micrometer.

In one prior art method, which might be characterized as a grinding method, a first surface of the wafer is drawn or pushed against a hard flat holder, thereby elastically deforming the wafer, while the second surface of the wafer is ground flat. When the wafer is released, elastic restoring forces in the wafer cause it to resume its original shape, and it can be seen that the waves in the first surface have been transferred to the surface that has been ground. Thus while this technique produces a wafer of more uniform thickness, it does not eliminate the residual saw waves.

In a second prior art method, which might be called a lapping method, the wafer is simultaneously lapped on both sides with an abrasive slurry in a lapping machine. Compared to a grinding process, the lapping process is slow and must be followed by careful cleaning and an etching step to relieve stresses before the wafer is polished. These additional steps cause the conventional method to be more expensive and time-consuming than the method of the present invention. Also, the etching process employed after the lapping step is undesirable from the environmental standpoint, because the strong acids used must be disposed of in an acceptable way. The present invention eliminates the need for the etching step.

The first of the above described prior art methods is illustrated by U.S. Pat. No. 4,918,869 to Kitta. This patent shows a technique in which the wafer is bonded to a rigid pressing plate. The rigid pressing plate is pushed by a diaphragm to press the wafer against a turntable.

In U.S. Pat. No. 5,205,082 issued Apr. 24, 1990, Shendon, et al. show a polishing apparatus in which an insert is used to adhere the wafer to the surface of a carrier. A flexible but impermeable diaphragm connects the carrier to the remainder of the polishing head.

In U.S. Pat. No. 5,212,910 issued May 25, 1993, Breibogel, et al. describe a composite polishing head having a 3-layer structure that enables the pad to conform to longitudinal gradations across the wafer.

In U.S. Pat. No. 5,230,184 issued Jul. 27, 1993, Bukhman describes a polishing head that has a flexible membrane. A number of polishing pads, made from a wafer that has been sawed into small pieces are attached to the exposed surface of the flexible membrane. A controlled air pressure operating against the flexible membrane forces the polishing pads against the workpiece with uniform force.

Each of the methods described above suffers from one or more limitations, such as high cost, slow speed, or lack of performance. Accordingly, the present inventors have searched for and found a novel method of exceptional performance and have devised apparatus for carrying out the method in an efficient manner.

BRIEF SUMMARY OF THE INVENTION

The present inventors recognized that the unsatisfactory results produced by prior art grinding methods were caused by the fact that the wafer was held in a deformed shape while the grinding operation was taking place. After the grinding was finished, the wafer was released, and it sprang back to approximately its original shape. (Typically, the grinding operation reduced the thickness of the wafer by less than ten percent.)

Having recognized the nature of the problem, the present inventors searched for ways of holding the wafer without deforming it.

One promising approach they found was to include a thick layer of high viscosity grease between the wafer and its rigid holder. The wafer reposed on the grease in an undeformed state, and because of its high viscosity the grease supported local areas on the wafer as they were ground. The disadvantages of this approach were the need to remove all of the grease from the wafer after the grinding process had been completed and the need to re-apply the grease to the rigid holder.

Contemplation of the grease technique led to discovery of the preferred embodiment in which the grease is replaced by a resilient pad. Initially it was not clear how the wafer and the resilient pad could be bound to each other and to the rigid wafer holder. The breakthrough, which made practical the use of a resilient pad, was the recognition that if the resilient pad included a plurality of perforations extending through it, then the wafer could be drawn against the resilient pad by the vacuum extending through the perforations in the resilient pad. Experimental results using this technique have been extremely favorable: the surface variations can be reduced from as much as 30 micrometers to less than one micrometer.

Further analysis of the method of the present invention revealed that the method is compatible for use with fully automated contemporary grinding machines because the method requires no handling or cleaning of the wafers by a human operator. In such a machine, the wafer is transferred onto the resilient pad by the machine. After the grinding of one face has been completed, the vacuum holding the wafer to the resilient pad is relieved, releasing the wafer, so that the machine can transfer it out of the way and replace it by the next wafer to be ground.

A further advantage of this method is its cleanliness. No grease gets on the wafer, and no inserts are needed to hold the wafer and pad in place. This is an important consideration when thousands of wafers are being processed each day.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE SEVERAL VIEWS OF THE DRAWING

FIG. 1 is a side elevational view in cross section showing apparatus used in a prior art method for grinding wafers;

FIG. 2 is a side elevational view in cross section showing apparatus used in the method of a first preferred embodiment of the present invention for grinding wafers;

FIG. 3 is a side elevational view in cross section showing apparatus used in the method of a second preferred embodiment of the present invention for grinding wafers; and, FIG. 4 is a fractional bottom plan view of a grinding wheel of a type shown in FIGS. 1, 2 and 3.

DETAILED DESCRIPTION OF THE INVENTION

FIG. 1 shows apparatus for performing a prior art grinding technique. The apparatus includes a rigid porous ceramic plate 12. A vacuum is maintained in a chamber 14 on one side of the plate 12, while the other side 16 of the plate 12 is exposed to the atmosphere. The pores in the plate 12 permit the vacuum to draw objects to the side 16 of the plate. Such apparatus has been used to draw a wafer 18 against the side 16 of the plate 12. The side 16 is extremely flat. After the wafer 18 has been placed on the side 16, a grinding wheel 20 is brought into contact with the exposed surface of the wafer. The grinding wheel 20 is rotated about the axis 22 while the wafer 18 and plate 12 are rotated about the axis 24.

The prior art technique of FIG. 1 is quite useful if the wafer 18 is perfectly flat initially and if one desires to reduce the thickness of the wafer. The underside of the grinding wheel 20 is shown in FIG. 4. It includes a plurality of grinding teeth, of which the tooth 34 is typical; each tooth is approximately 3.0 millimeters wide in the radial direction. The teeth are spaced from one another to permit circulation of a fluid, and the grinding teeth include a layer of fine diamonds held in place by a resin bond.

Unfortunately, the surfaces of a freshly sawed wafer are not flat, but instead include waves that depart from flatness by amounts on the order of 30 micrometers. When such a wafer is placed on the rigid flat ceramic plate 12, the side of the wafer facing the plate is drawn against the flat side 16 and thus is elastically deformed into flatness. Thereafter, the grinding wheel 20 grinds the exposed surface of the wafer typically removing about 30 micrometers. However, when the wafer is removed from the plate 12, elastic restoring forces within the wafer cause it to spring back into approximately its original shape. The waviness of the side of the wafer that faced the plate 12 remains, and because the wafer is now more uniform in thickness, that waviness becomes propagated to the side of the wafer that was ground. In view of this explanation, it can be appreciated that the prior art grinding technique as shown in FIG. 1 cannot be expected to remove the waviness.

The insight of the present inventors was to recognize that the wafer must be held in an undeformed (relaxed) condition while it is being ground, so that when released it will not change shape and therefore the ground side will remain flat. They also recognized that once a flat side has been produced on a wafer, then the technique of FIG. 1 can be used to planarize the other side.

One technique considered by the present inventors is to apply a thick coating of grease to the wafer holder and then bring one side of the wafer into contact with the exposed surface of the grease. The wafer is then partially supported by the grease, and because the weight of the wafer is distributed uniformly across the wafer, the wafer is not deformed from its original shape. At this point, the temperature could be lowered so that the grease would become thicker so as to better oppose any localized stresses that might be imposed on the wafer by the grinding process. In place of a grease, a wax or pitch could be used.

This approach did not appear to be compatible with the apparatus shown in FIG. 1 because the grease would clog the pores in the plate 12. Other disadvantages include the need to remove the grease or other material from the wafer after the grinding has been completed. For these and other good reasons, this approach is not considered to be the preferred embodiment, however, it may be thought of as an alternative embodiment.

Continuing their search for a way to hold the wafer without deforming it during the grinding process, the inventors next hit on the idea of inserting a perforated resilient pad 26 between the rigid plate 12 and the wafer 18, as shown in FIG. 2. Immediately it is seen that this approach is compatible with existing grinding equipment of FIG. 1. The resilient pad 26 of FIG. 2 is composed of an impervious material such as MYLAR, a polyester, but includes a multitude of perforations that extend all the way through it. MYLAR is a registered trademark of E.I. DuPont de Nemours and Company.

In the preferred embodiment, the resilient pad 26 is affixed to the porous plate 12 by a peelable adhesive, so that the resilient pad will remain in place when the vacuum is relieved to free the wafer. In this way, hundreds of wafers can be ground using the same resilient pad. When the resilient pad eventually needs to be replaced, it is peeled loose from the plate, leaving no residue, and a new resilient pad is applied to the porous plate by the operator. In an alternative embodiment, the resilient pad is held against the plate by a removable clip.

The perforations, of which the perforation 28 is typical, permit the vacuum to be applied to the workpiece, namely a wavy wafer, which is drawn against the resilient pad by the vacuum. The perforations are uniformly distributed across the face of the wafer, and accordingly, the atmospheric pressure forcing the wafer against the resilient pad is substantially uniform across the wafer. Therefore, the wafer is not deformed from its original shape even though it is held securely enough for the grinding operation to be carried out. The perforations are approximately 1.2 millimeters in diameter in the preferred embodiment.

The second preferred embodiment, shown in FIG. 3 differs from the first preferred embodiment of FIG. 2 only in that the flat rigid porous ceramic plate 12 of FIG. 2 is replaced by a flat rigid plate 30 of FIG. 3 having a plurality of passages extending through it from its first face to its second face; the passage 32 is typical. The perforations 28 of the resilient pad must register, at least partially, with the passages 32.

Thus, in accordance with the present invention, the perforated resilient pad 26 is placed over the exposed surface of the rigid porous ceramic plate 12 of FIG. 2 or the flat rigid plate 30 of FIG. 3, and then the wafer 18 is placed on the exposed surface of the pad 26 and the grinding operation is carried out. Once the exposed surface of the wafer has been rendered flat, the vacuum is relieved, and the wafer is removed from the resilient pad. At that point the ground side of the wafer remains flat because the wafer, not having been deformed, does not spring back to its original wavy condition. A flat side having been produced on the wafer, the other side of the wafer is then planarized by the conventional technique of mounting it on a flat rigid platform. The end result is a wafer having two flat surfaces, and the wafer is said to have been planarized.

Thus, it is seen that the method of the preferred embodiment of the present invention is entirely compatible with existing grinding equipment and requires merely the insertion of a perforated resilient pad between the wafer and the ceramic plate 12. Additionally, the method of the preferred embodiment is as clean as any grinding method can be and does not require degreasing of the finished wafer or a chemical etching step to relieve stresses (as in a conventional lapping method). Further, no special inserts are required to hold the wafer to the wafer holder during the grinding process. Even at a low unit cost, the total cost of such inserts can be considerable when thousands of wafers are planarized each day.

Thus, there has been described apparatus and a method for planarizing wavy wafers, such as wafers that have previously been cut from a boule by use of a wire saw. The method is compatible with existing grinding machines and does not complicate the normal grinding procedure. Although the present invention arose from the semiconductor industry where extremely flat wafers of silicon are needed, it should be clear that the method and apparatus of the present invention are not limited to the planarization of silicon wafers. For example, the workpiece need not be composed of silicon; the invention is applicable to any hard material such as glass, artificial rubies, and minerals. Further, the workpiece does not need to be disc-shaped; its plan view could have any shape so long as the workpiece is generally plate-like; i.e., of approximately uniform thickness.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. In a grinding apparatus for substantially improving the flatness of an extended first surface of a wavy wafer having a second surface extending substantially parallel to the first surface, said grinding apparatus of a type including a porous plate having an extended first surface and a second surface extending substantially parallel to the first surface, the second surface of the wafer being held during the grinding, in conventional usage, against the first surface of the porous plate by a vacuum applied to the second surface of the porous plate, the improvement comprising:

a perforated resilient pad interposed between and in contact with the first surface of the porous plate and the second surface of the wavy wafer, wherein the perforated resilient pad includes perforations having a diameter of approximately 1.2 millimeters.

2. A grinding process for substantially improving the flatness of an extended first surface of a wavy wafer having a second surface extending substantially parallel to the first surface, said process comprising the steps of:

providing a plate of a porous material, having an extended first surface and a second surface extending substantially parallel to the first surface;

providing a perforated resilient pad of substantially uniform thickness, having an extended first surface and a second surface extending substantially parallel to the first surface;

applying a vacuum to the second surface of the plate of a porous material;

placing the second surface of the perforated resilient pad in contact with the first surface of the plate of porous material;

placing the second surface of the wavy wafer in contact with the first surface of the perforated resilient pad; and, grinding the first surface of the wavy wafer to render it flat.

3. In a grinding apparatus for substantially improving the flatness of an extended first surface of a wavy wafer having a second surface extending substantially parallel to the first surface, said grinding apparatus of a type including a plate having an extended first surface and a second surface extending substantially parallel to the first surface, said plate having passages extending through it from said first surface to said second surface, the second surface of the wafer being held during the grinding, in conventional usage, against the first surface of the plate by a vacuum applied to the second surface of the plate, the improvement comprising:

a perforated resilient pad interposed between and in contact with the first surface of the plate and the second surface of the wavy wafer, wherein the perforated resilient pad includes perforations having a diameter of approximately 1.2 millimeters.

4. A grinding process for substantially improving the flatness of an extended first surface of a wavy wafer having a second surface extending substantially parallel to the first surface, said process comprising the steps of:

providing a plate having an extended first surface and a second surface extending substantially parallel to the first surface, said plate having passages extending through it from said first surface to said second surface;

providing a perforated resilient pad of substantially uniform thickness, having an extended first surface and a second surface extending substantially parallel to the first surface;

applying a vacuum to the second surface of the plate;

placing the second surface of the perforated resilient pad in contact with the first surface of the plate;

placing the second surface of the wavy wafer in contact with the first surface of the perforated resilient pad; and, grinding the first surface of the wavy wafer to render it flat.

5. In a grinding apparatus for substantially improving the flatness of an extended first surface of a wavy wafer having a second surface extending substantially parallel to the first surface, said grinding apparatus of a type including a porous plate having an extended first surface and a second surface extending substantially parallel to the first surface, the second surface of the wafer being held during the grinding, in conventional usage, against the first surface of the porous plate by a vacuum applied to the second surface of the porous plate, the improvement comprising:

a perforated resilient pad interposed between and in contact with the first surface of the porous plate and the second surface of the wavy wafer; and, means for applying a vacuum to the second surface of the porous plate so that the vacuum draws the perforated resilient pad against the first surface of the porous plate and draws the second surface of the wavy wafer against the perforated resilient pad.

6. In a grinding apparatus for substantially improving the flatness of an extended first surface of a wavy wafer having a second surface extending substantially parallel to the first surface, said grinding apparatus of a type including a plate having an extended first surface and a second surface extending substantially parallel to the first surface, said plate having passages extending through it from said first surface to said second surface, the second surface of the wafer being held during the grinding, in conventional usage, against the first surface of the plate by a vacuum applied to the second surface of the plate, the improvement comprising:

a perforated resilient pad interposed between and in contact with the first surface of the plate and the second surface of the wavy wafer; and, means for applying a vacuum to the second surface of the plate so that the vacuum draws the perforated resilient pad against the first surface of the plate and draws the second surface of the wavy wafer against the perforated resilient pad.

* * * * *